United States Patent [19]

Cooper et al.

[11] 4,356,927

[45] Nov. 2, 1982

[54] POP-UP STRAW FOR BEVERAGE CANS

[76] Inventors: George W. Cooper; Gloria A. Clark, both of 2210 Jessup St., Wilmington, Del. 19802

[21] Appl. No.: 302,195

[22] Filed: Sep. 14, 1981

[51] Int. Cl.[3] ..... B65D 47/06

[52] U.S. Cl. ..... 220/90.2; 206/217; 229/7 S; 239/33; 215/1 A

[58] Field of Search ..... 206/217, 218, 139, 804; 229/7 S; 239/24, 33, 28; 215/15, 1 A; 220/90.4, 90.2, 70; 9/344

[56] References Cited

U.S. PATENT DOCUMENTS

| | | | |
|---|---|---|---|
| 942,306 | 12/1909 | Clarke | 239/33 |
| 3,326,695 | 6/1967 | Neuhauser | 239/33 |
| 3,349,955 | 10/1967 | Cornelius | 229/7 S |
| 3,409,224 | 11/1968 | Harp et al. | 239/33 |
| 3,542,278 | 11/1970 | Deaver | 229/7 S |
| 3,656,654 | 4/1972 | Brinkley | 229/7 S |
| 3,871,541 | 3/1975 | Adomaitis | 220/70 |
| 3,966,077 | 6/1976 | Jardine | 220/70 |
| 4,109,817 | 8/1978 | Payne et al. | 229/7 S |
| 4,226,356 | 10/1980 | Lemelson | 215/1 A |
| 4,228,913 | 10/1980 | Mack et al. | 229/7 S |
| 4,305,521 | 12/1981 | Komatsuta et al. | 229/7 S |

*Primary Examiner*—William T. Dixson, Jr.
*Assistant Examiner*—Jimmy G. Foster

[57] ABSTRACT

A beverage can and a pop-up straw installed therein, together with a beverage; the straw, at one end, resting on the can bottom wall, and, at its other end, bearing against an underside of a tab on the can top wall.

4 Claims, 11 Drawing Figures

Fig. 1
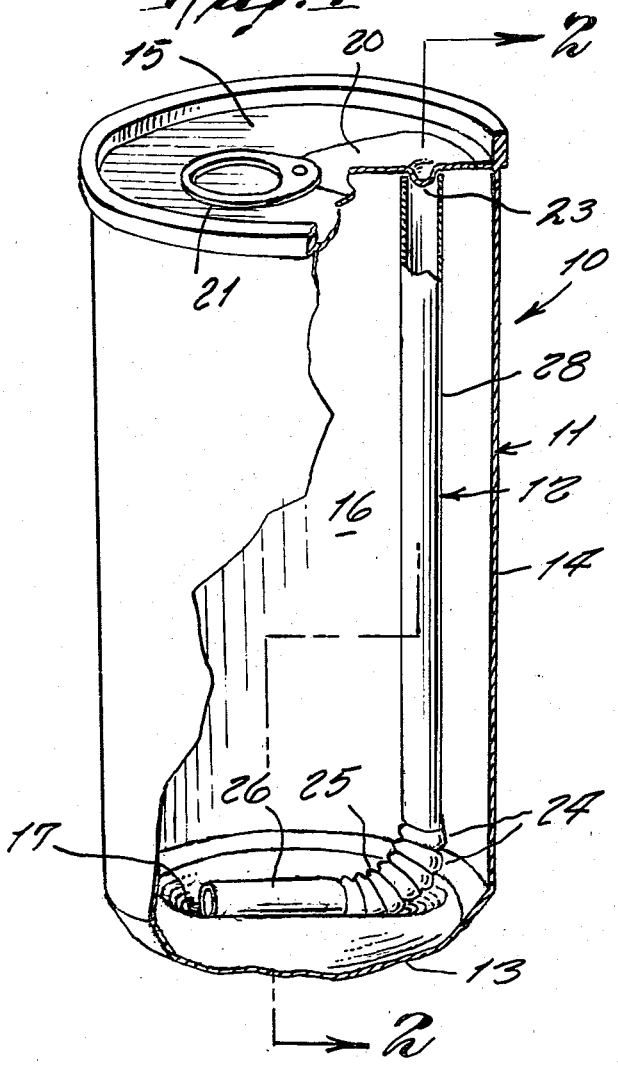
Fig. 2
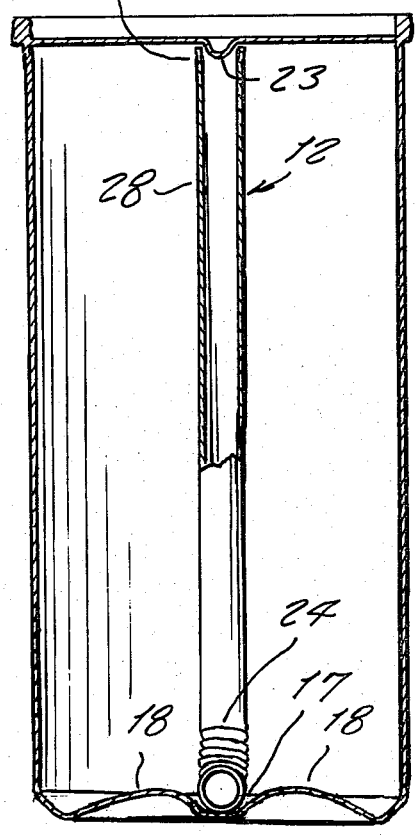
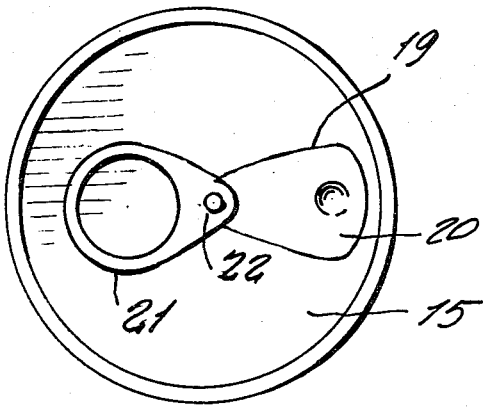
Fig. 3
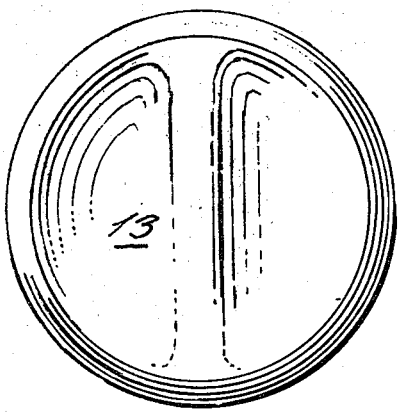
Fig. 4

Fig. 5
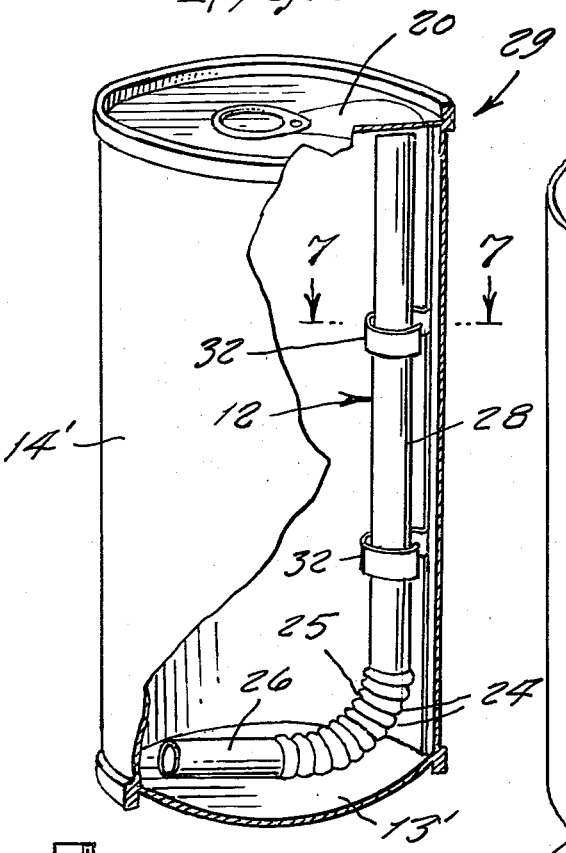
Fig. 6
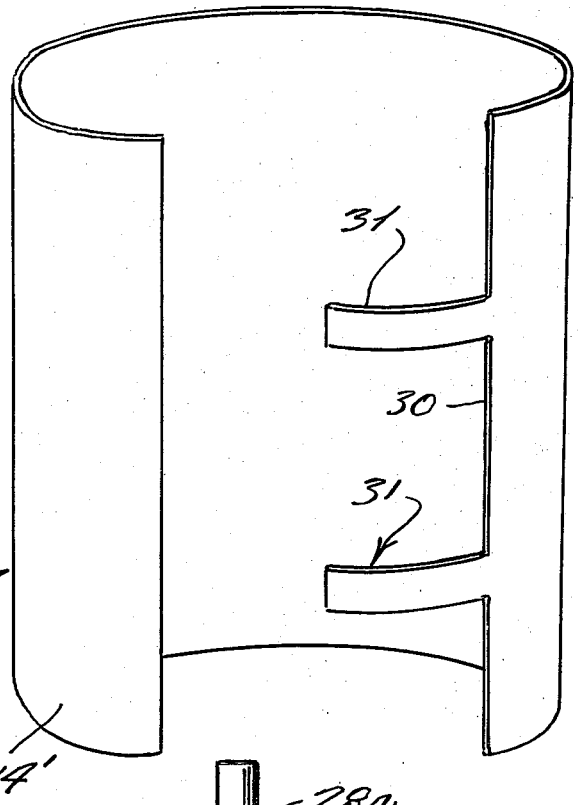
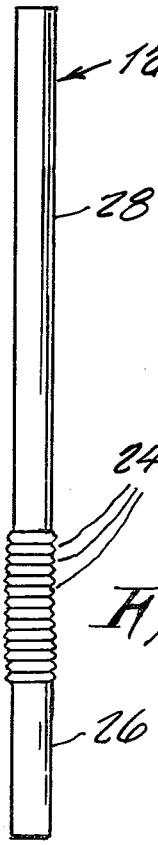
Fig. 8
Fig. 7
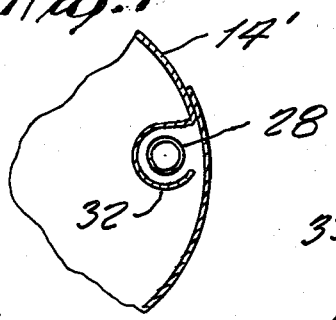
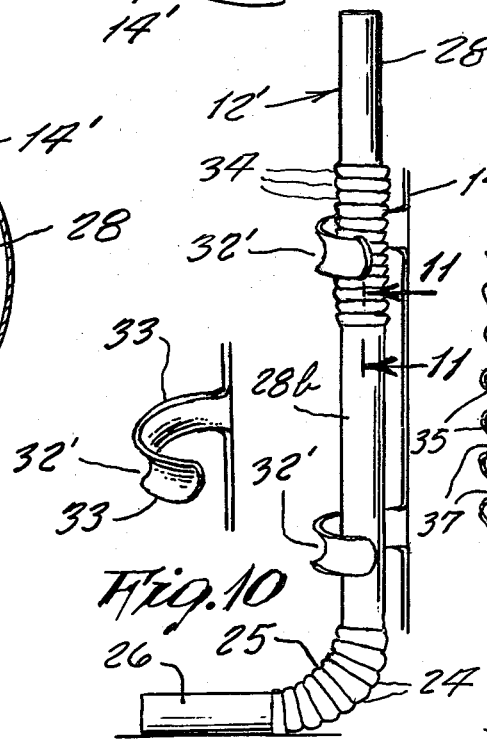
Fig. 10
Fig. 9
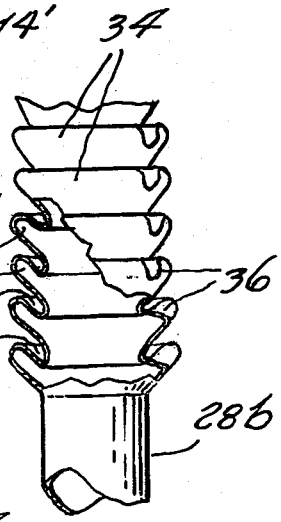
Fig. 11

POP-UP STRAW FOR BEVERAGE CANS

This invention relates generally to drinking straws. More specifically, it relates to a combination drinking straw and a beverage can, such as is used for containing beverages, such as soft drinks and the like.

It is well known, that pop-up straws for beverage cans have been developed in the past; however, in view of the fact that none of them are now on the market, it may be readily assumed that there is still room for improvement therein, so as to be more adaptable for the large awaiting market therefor.

Accordingly, it is a principal object of the present invention to provide a drinking straw which pops up out of a beverage can when the can is opened up, so that the beverage may be readily sipped up, without the need of handling a separate straw for placement into the can opening.

Another object is to provide a beverage can that is specifically designed for the particular pop-up straw, so that, when the can is opened, the pop-up action of the straw is assured to take place.

Other objects are to provide a beverage can that is specifically designed for the particular pop-up straw, which is simple in design, inexpensive to manufacture, rugged in construction, easy to use, and efficient in operation.

These, and other objects, will be readily evident, upon a study of the following specification, and the accompanying drawings, wherein:

FIG. 1 is a perspective view of a beverage can, shown partly broken away, so as to illustrate one design of the invention therewithin;

FIG. 2 is an elevational side cross-sectional view, taken on line 2—2 of FIG. 1;

FIG. 3 is a top plan view of the can, as shown in FIG. 1;

FIG. 4 is a bottom plan view of the can as shown in FIG. 2;

FIG. 5 is a perspective view of another design of the invention, shown partly in cross-section;

FIG. 6 is a perspective view of the can side wall, shown partly rolled open during the can construction;

FIG. 7 is a cross-sectional view, on line 7—7 of FIG. 5;

FIG. 8 is a side elevational view of the straw, shown alone;

FIG. 9 is a side elevational view of a modified construction, in which the straw guides have rounded edges, in order that the straw does not get hung up on the edges, when floating upwardly;

FIG. 10 is an enlarged detail view of the guide shown in FIG. 9, and

FIG. 11 is an enlarged cross-sectional view, taken on line 11—11 of FIG. 9, and showing the accordian pleats being upwardly tilted, in order to hold air better, for flotation.

Referring now to the drawings in greater detail, and more particularly, to FIGS. 1 through 4 thereof, at this time, the reference numeral 10 represents an assembly of the present invention, wherein there is a beverage can 11, and a pop-up straw 12 that is contained inside the can.

The beverage can includes a bottom wall 13, integral with a side wall 14, and which are formed from a single sheet of metal, that is deep drawn in manufacturing process. The can also includes a top wall 15, made from a sheet metal, and which, at its edges, is crimped to the upper edge of the top wall, so as to form a central compartment 16, for containing beverage in a sealed condition.

The bottom wall 13 includes a downwardly, transverse, central depression 17, formed between upwardly rounded bottom wall portions 18.

The top wall includes a scored line 19, that defines a tab 20, for being torn off when opening up the can. A pull ring 21 is attached by a rivet 22 to the tab. A downward dimple is formed on the tab, in order to form a rounded protrusion 23 on the tab underside.

The straw 12 is preferably made from a plastic material, in order not to deteriorate while being submerged in the beverage for the entire time prior to opening the can. A plurality of circular corrugated pleats 24 are formed along a longitudinally intermediate portion of the straw, so as to form a gently rounded elbow 25 along the straw, while one end portion 26 of the straw rests in the depression 17, and the opposite terminal end 27 of the straw is fitted around the protrusion 23, the straw being retained therebetween by means of the corrugations being compressed, so as to urge the upper end portion 28 into an upwardly direction.

Thus, when the tab is torn off, the upper end portion 28 of the straw pops up outwardly of the can, so that a person can conveniently sip on it.

Referring now to FIGS. 5 through 8, another design 29 of the invention is shown, wherein the can is made with the side wall 14' being separately made from the bottom wall 13', to which it is subsequently crimped during the can manufacture. The side wall is, accordingly, rolled into shape, and one of its side edges 30 includes a pair of extending tongues 31, which are then rounded, so as to form guides 32, in which the straw is loosely held, and which, accordingly, guide the straw for only an upwardly sliding movement in the guides.

As shown, in FIG. 5, the tab 20' therefore does not include the above-identified protrusion 23, and the bottom wall 13' does not include the depression 17.

FIGS. 9 and 10 illustrate a slightly modified design of guides 32', having upper and lower edges 33 thereof, which are outwardly rounded, in order not to let the sliding straw get hung up thereon.

FIG. 9 illustrates another design of straw 12', which additionally includes a second group of corrugated pleats 34, located along the upper end portion 28, so as to divide it into portions **28*a* and 28*b*, the corrugations 34 serving additionally to raise the upper end of the straw out of the can, when the can is opened. As shown in FIG. 11, each corrugation is upwardly tilted, so as to form an air trap 35, which aids in raising the straw in the beverage. A row of downward bends 36, on the corrugations 34, permits beverage to run out of the gutters 37** so as not to weigh down the straw from rising.

While various changes may be made in the detail construction, it is understood that such changes will be within the spirit and scope of the present invention, as is defined by the appended claims.

What we now claim is:

1. A pop-up straw and beverage can assembly, comprising, in combination, a beverage can containing a beverage, and a pop-up straw installed inside said can, said can including a removable tab on its top wall, and said straw including a plurality of accordian pleats for compressing said straw in said can under said tab, said pleats including flotation means, and a lower end portion of said straw resting upon the bottom wall of said can.

2. The combination as set forth in claim 1, wherein said bottom wall includes a central depression, in which said straw lower portion is rested.

3. The combination as set forth in claim 2, wherein guides along a side wall of said can support said straw.

4. The combination as set forth in claim 3, wherein a second group of pleats form a curved elbow along said straw.

* * * * *